US009189007B2

(12) United States Patent
Ko et al.

(10) Patent No.: US 9,189,007 B2
(45) Date of Patent: Nov. 17, 2015

(54) POWER SUPPLY REGULATOR

(75) Inventors: Chen-Ting Ko, Hsinchu (TW); Jinn-Yeh Chien, Chu Bei (TW)

(73) Assignee: TAIWAN SEMICONDUCTOR MANUFACTURING COMPANY, LTD., Hsin-Chu (TW)

( * ) Notice: Subject to any disclaimer, the term of this patent is extended or adjusted under 35 U.S.C. 154(b) by 377 days.

(21) Appl. No.: 13/044,994

(22) Filed: Mar. 10, 2011

(65) Prior Publication Data

US 2012/0229198 A1 Sep. 13, 2012

(51) Int. Cl.
*G05F 1/10* (2006.01)
*G05F 3/08* (2006.01)

(52) U.S. Cl.
CPC ..... *G05F 3/08* (2013.01)

(58) Field of Classification Search
CPC ..... H01L 2924/00; G05F 1/56; G05F 3/205; G05F 3/262; G05F 3/30
See application file for complete search history.

(56) References Cited

U.S. PATENT DOCUMENTS

| | | | | |
|---|---|---|---|---|
| 5,751,176 | A * | 5/1998 | Sohn et al. | 327/295 |
| 6,255,850 | B1 | 7/2001 | Turner | |
| 6,281,735 | B1 | 8/2001 | Page | |
| 6,667,607 | B2 | 12/2003 | Kawamura et al. | |
| 7,602,161 | B2 | 10/2009 | McLeod | |
| 2005/0225391 | A1 * | 10/2005 | Zhang et al. | 330/264 |
| 2008/0111532 | A1 * | 5/2008 | Tran et al. | 323/313 |
| 2009/0115258 | A1 * | 5/2009 | Flynn et al. | 307/129 |
| 2010/0045364 | A1 | 2/2010 | Law et al. | |
| 2010/0253303 | A1 | 10/2010 | Chern et al. | |
| 2010/0259239 | A1 | 10/2010 | Shi et al. | |

* cited by examiner

*Primary Examiner* — Sibin Chen
(74) *Attorney, Agent, or Firm* — Haynes and Boone, LLP

(57) ABSTRACT

Power supply regulators, integrated circuits including a power supply regulator, and methods of regulating a power supply are provided. In one embodiment, a power supply regulator includes a first self-bias circuit configured to receive a supply voltage from a power supply, a second self-bias circuit coupled to a reference voltage, and a clamping circuit coupled between the first and second self-bias circuits. The clamping circuit includes a NMOS transistor coupled to the first self-bias circuit and a PMOS transistor coupled to the second self-bias circuit. The clamping circuit is further configured to generate an output voltage less than the supply voltage at substantially the same time as when the supply voltage is received from the power supply.

19 Claims, 6 Drawing Sheets

POWER SUPPLY REGULATOR

TECHNICAL FIELD

The present disclosure relates generally to integrated circuits, and more particularly, to circuits and methods for regulating a power supply.

BACKGROUND

Input/output ("I/O") circuits are used to input electronic signals to and output electronic signals from integrated circuits. A typical integrated circuit ("IC") includes an integral I/O circuit for each of its externally accessible I/O pins. An I/O circuit usually includes a driver circuit which receives signals from the IC and outputs them to the I/O pin. It also generally includes an input buffer which receives signals from the I/O pin and inputs them to the IC. A typical I/O circuit also includes an enable circuit which can place the driver circuit in either a high impedance state in which signals can be input to the IC via the I/O pin, or in an output enabled state in which signals can be output from the IC via the I/O pin.

I/O circuits transfer signals to and from integrated circuit devices in a variety of types of electronic systems. For instance, I/O circuits may be used to interconnect integrated circuits to a shared system bus so that multiple ICs connected to the bus can communicate with each other. In many electronic systems all of the ICs connected to a system bus operate at the same supply voltage level. However, as the dimensions of the circuits in ICs have decreased, the supply voltages employed by ICs also have decreased. As a result, there has been a proliferation of mixed signal systems in which some ICs connected to a system bus operate at a higher supply voltage (e.g., 3.3-volts), and other ICs connected to the same system bus operate at a lower supply voltage (e.g., 1.65-volts).

A voltage regulator may be used to enable circuits/systems to operate using only one supply voltage from a power supply, with the voltage regulator providing various subcircuits and/or subsystems with different individual supply voltages. However, timing dead zone problems, which may cause hot carrier injection and gate oxide integrity issues, and power sequence problems have been encountered with multiple power domains. Thus, improved methods, systems, and apparatus for regulating power supplies are desirable.

SUMMARY

The present disclosure provides for various advantageous circuits and methods for regulating a power supply. One of the broader forms of the present disclosure involves a power supply regulator including a first self-bias circuit configured to receive a supply voltage from a power supply, a second self-bias circuit coupled to a reference voltage, and a clamping circuit coupled between the first and second self-bias circuits. The clamping circuit includes an NMOS transistor coupled to the first self-bias circuit and a PMOS transistor coupled to the second self-bias circuit. The clamping circuit is further configured to generate an output voltage less than the supply voltage at substantially the same time as when the supply voltage is received from the power supply.

Another of the broader forms of the present disclosure involves an integrated circuit including a power supply regulator coupled to a power supply providing a supply voltage, and a circuit configured to receive an output voltage from the power supply regulator. The power supply regulator includes a first self-bias circuit configured to receive the supply voltage from the power supply, the first self-bias circuit including a first set of resistors and a first transistor coupled to the power supply; a second self-bias circuit including a second set of resistors and a second transistor coupled to a reference voltage; and a clamping circuit including an NMOS transistor coupled to the first transistor, and a PMOS transistor coupled to the second transistor. The clamping circuit is configured to generate an output voltage less than the supply voltage at substantially the same time as when the supply voltage is received from the power supply.

Yet another of the broader forms of the present disclosure involves a method of regulating a power supply. The method includes receiving a supply voltage from a power supply at a first self-bias circuit, receiving a reference voltage at a second self-bias circuit, and generating an output voltage from a clamping circuit coupled between the first and second self-bias circuits. The clamping circuit includes an NMOS transistor coupled to the first self-bias circuit and a PMOS transistor coupled to the second self-bias circuit, the output voltage is less than the supply voltage, and the output voltage is generated at substantially the same time as when the supply voltage is received from the power supply.

BRIEF DESCRIPTION OF THE DRAWINGS

Aspects of the present disclosure are best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

It is understood that the following disclosure provides many different embodiments, or examples, for implementing different features of the invention. Specific examples of components and arrangements are described below to simplify the present disclosure. These are, of course, merely examples and are not intended to be limiting. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Various features may be arbitrarily drawn in different scales for the sake of simplicity and clarity. It is noted that the same or similar features may be similarly numbered herein for the sake of simplicity and clarity.

Figure 1:
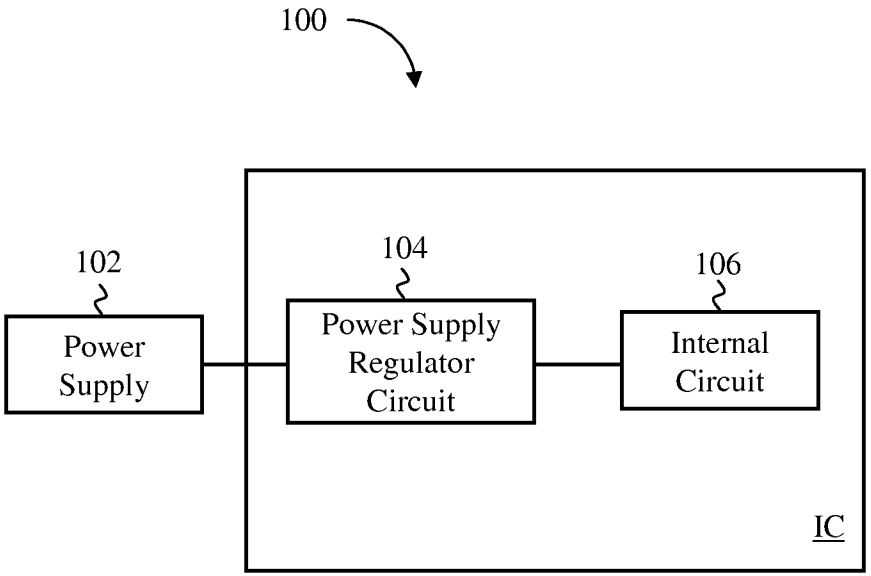
FIG. 1 is a schematic block diagram showing a system including a power supply regulator circuit coupled to an internal circuit.

Referring now to FIG. 1, a schematic block diagram shows a system 100 including a power supply regulator 104 coupled to an internal circuit 106 in accordance with various aspects of the present disclosure. A power supply 102 is coupled to the power supply regulator circuit 104.

Power supply 102 may provide DC voltage in one example, but may include any of various power supplies for providing current and/or voltage.

In one example, power supply regulator 104 and internal circuit 106 may be provided over a substrate, such as a semiconductor substrate, and may be comprised of silicon, or alternatively may include silicon germanium, gallium arsenic, or other suitable semiconductor materials. The substrate may further include doped active regions and other features such as a buried layer, and/or an epitaxy layer. Furthermore, the substrate may be a semiconductor on insulator such as silicon on insulator (SOI). In other embodiments, the semiconductor substrate may include a doped epitaxy layer, a gradient semiconductor layer, and/or may further include a semiconductor layer overlying another semiconductor layer of a different type such as a silicon layer on a silicon germanium layer. In other examples, a compound semiconductor substrate may include a multilayer silicon structure or a silicon substrate may include a multilayer compound semiconductor structure. The active region may be configured as an NMOS device (e.g., nFET) or a PMOS device (e.g., pFET). The semiconductor substrate may include underlying layers, devices, junctions, and other features (not shown) formed during prior process steps or which may be formed during subsequent process steps.

The regulated voltage/current from power supply regulator 104 may be applied to various internal circuits 106, such as various integrated circuits and/or printed circuit boards (PCBs), for operations. Internal circuit 106 provides a load, and can include a processing unit, central processing unit, digital signal processor, memory circuits, other integrated circuit that can receive the regulated voltage for operations, and/or combinations thereof. In some embodiments, power supply regulator 104 and internal circuit 106 may be disposed within a single integrated circuit, PCB, or chip.

Examples of power supply regulator 104 in accordance with various embodiments of the present disclosure will be further described below.

Figure 3:
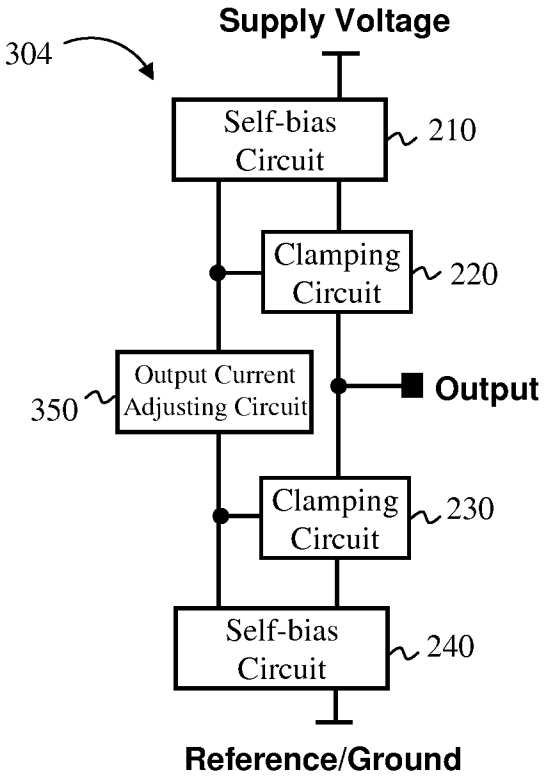
FIGS. 2 and 3 are schematic block diagrams illustrating power supply regulators in accordance with various embodiments of the present disclosure.
Figure 2:
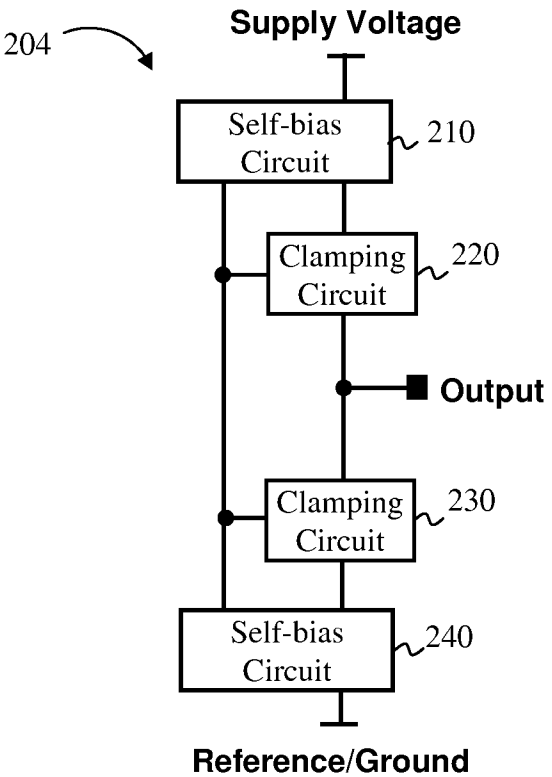

Referring now to FIGS. 2 and 3, schematic block diagrams are shown illustrating power supply regulators 204 and 304, respectively, in accordance with various embodiments of the present disclosure.

Power supply regulator 204 includes a first self-bias circuit 210 configured to receive a supply voltage from a power supply, a second self-bias circuit 240 coupled to a reference voltage or ground, and clamping circuits 220 and 230 coupled between the first and second self-bias circuits 210 and 240.

In accordance with various embodiments of the present disclosure, first and second self-bias circuits 210, 240 each provide a bias voltage to respective clamping circuits 220, 230 to substantially prevent over-stress to the clamping circuits.

In accordance with various embodiments of the present disclosure, clamping circuits 220 and 230 are configured to generate an output voltage less than the supply voltage at substantially the same time as when the supply voltage is received from the power supply. Clamping circuits 220 and 230 may be further configured to generate the output voltage without a timing dead zone. Clamping circuits 220 and 230 may be further configured to generate a positive output voltage clamped between a minimum clamp voltage and a maximum clamp voltage. In other words, the output voltage may be clamped to a positive voltage level. Clamping circuits 220 and 230 advantageously provide a safe output voltage in either a power on/off mode or an operation mode.

Power supply regulator 304 is similar to power supply regulator 204 and also includes first self-bias circuit 210 configured to receive a supply voltage from a power supply, second self-bias circuit 240 coupled to a reference voltage or ground, and clamping circuits 220 and 230 coupled between the first and second self-bias circuits 210 and 240. Power supply regulator 304 further includes an output current adjusting circuit 350 coupled between first and second self-bias circuits 210 and 240 and between clamping circuits 220 and 230 for adjusting the output current from the power supply regulator. In accordance with various embodiments of the present disclosure, first and second self-bias circuits 210, 240 each provide a bias voltage to respective clamping circuits 220, 230 and the output current adjusting circuit 350 to substantially prevent over-stress to the clamping circuits and the output current adjusting circuit.

Referring now to FIGS. 4-8, schematic circuit diagrams are shown illustrating power supply regulators 404, 504, 604, 704, and 804, respectively, in accordance with various embodiments of the present disclosure.

Figure 5:
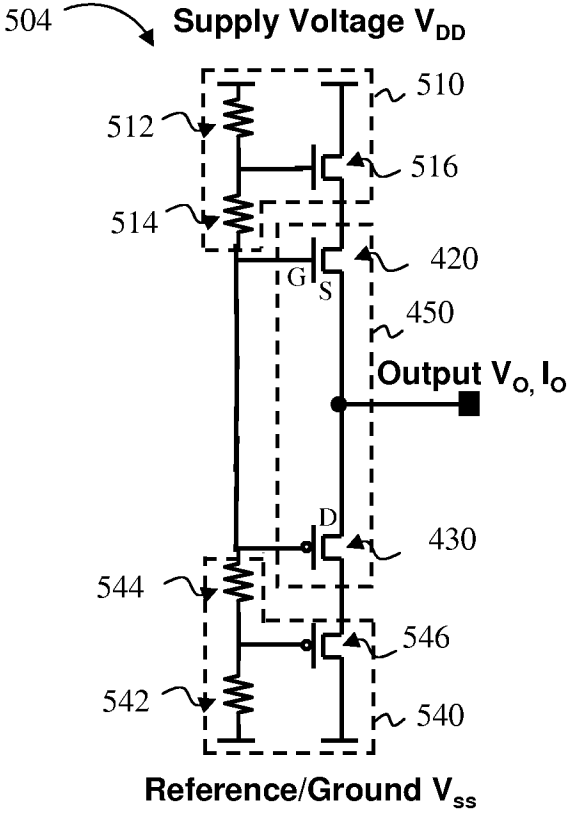
FIGS. 4-8 are schematic circuit diagrams illustrating power supply regulators in accordance with various embodiments of the present disclosure.
Figure 4:
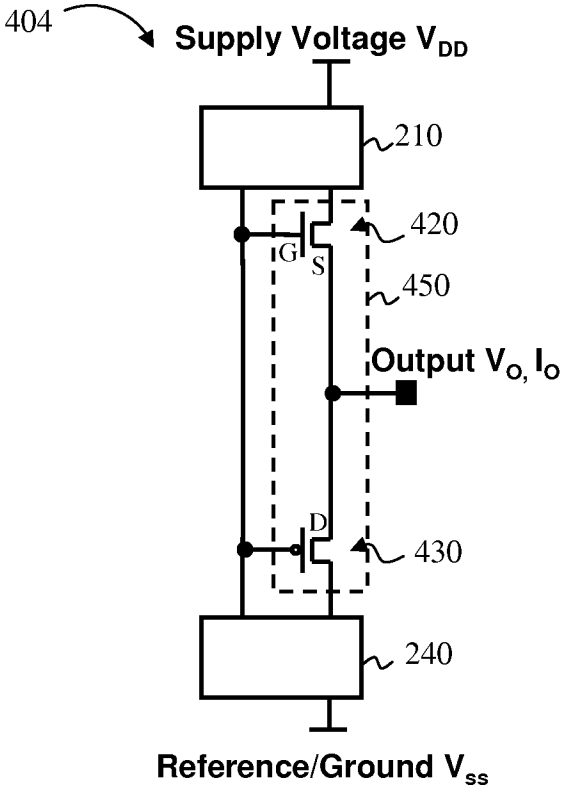

Referring in particular to FIGS. 4 and 5 in conjunction with FIG. 2, power supply regulators 404 and 504 are similar to power supply regulator 204. Power supply regulator 404 includes first self-bias circuit 210 configured to receive a supply voltage $V_{DD}$ from a power supply (e.g., power supply 102 of FIG. 1), second self-bias circuit 240 coupled to a reference voltage or ground $V_{SS}$, and a clamping circuit 450 coupled between the first and second self-bias circuits 210 and 240. Power supply terminals provide the power supply voltage (e.g., +3.3 V) and the reference or ground voltage to the regulator circuit. It is noted, that as an alternative, the system can also be based on a negative power supply voltage with a terminal $V_{DD}$ serving as the reference terminal and $V_{SS}$ serving as the negative power supply voltage terminal.

In one embodiment, clamping circuit 450 includes an NMOS transistor 420 coupled to first self-bias circuit 210, and a PMOS transistor 430 coupled to second self-bias circuit 240. In one example, a drain terminal of NMOS transistor 420 is coupled to first self-bias circuit 210, a source terminal of NMOS transistor 420 is coupled to a drain terminal of PMOS transistor 430, and a source terminal of PMOS transistor 430 is coupled to second self-bias circuit 240.

In accordance with various embodiments of the present disclosure, clamping circuit 450 is configured to generate an output voltage $V_O$ (and output current $I_O$) less than the supply voltage $V_{DD}$ at substantially the same time as when the supply voltage $V_{DD}$ is received from the power supply, and/or clamping circuit 450 is configured to generate the output voltage without a timing dead zone. Output voltage $V_O$ and output current $I_O$ are provided at an output node between NMOS transistor 420 and PMOS transistor 430.

In accordance with various embodiments of the present disclosure, clamping circuit 450 is further configured to generate a positive output voltage $V_O$ clamped between a minimum clamp voltage and a maximum clamp voltage. In one example, the positive output voltage is about half of the supply voltage $V_{DD}$ from the power supply, the minimum clamp voltage is about −10% of the positive voltage output, and the maximum clamp voltage is about +10% of the positive voltage output. In another example, the positive output voltage is about 1.65 V at 0 loading current, the minimum clamp voltage is about 1.5 V, and the maximum clamp voltage is about 1.8 V.

Power supply regulator 504 is similar to power supply regulator 404 and includes a first self-bias circuit 510 configured to receive a supply voltage $V_{DD}$ from a power supply (e.g., power supply 102 of FIG. 1), a second self-bias circuit 540 coupled to a reference voltage or ground $V_{SS}$, and clamping circuit 450 coupled between the first and second self-bias circuits 510 and 540.

In one embodiment, clamping circuit 450 includes NMOS transistor 420 coupled to first self-bias circuit 510, and PMOS transistor 430 coupled to second self-bias circuit 540. In one example, the first self-bias circuit 510 includes a first set of resistors 512, 514 and a first transistor 516 coupled to the supply voltage $V_{DD}$ or power supply, and the second self-bias circuit 540 includes a second set of resistors 542, 544 and a second transistor 546 coupled to the reference voltage $V_{SS}$. The first set of resistors 512 and 514 may be coupled in series and the second set of resistors 542 and 544 may be coupled in series. In another example, the first transistor 516 is coupled between NMOS transistor 420 and the supply voltage $V_{DD}$, and the second transistor 546 is coupled between PMOS transistor 430 and the reference voltage $V_{SS}$. In yet another example, a gate of the first transistor 516 is coupled between resistor 512 and resistor 514, and a gate of the second transistor 546 is coupled between resistor 542 and resistor 544. Gate terminals of NMOS transistor 420 and PMOS transistor 430 are coupled between resistor 514 and resistor 544, and thus the gate terminals of NMOS transistor 420 and PMOS transistor 430 are between and receive bias signals from the first and second self-bias circuits 510 and 540, respectively.

Figure 8:
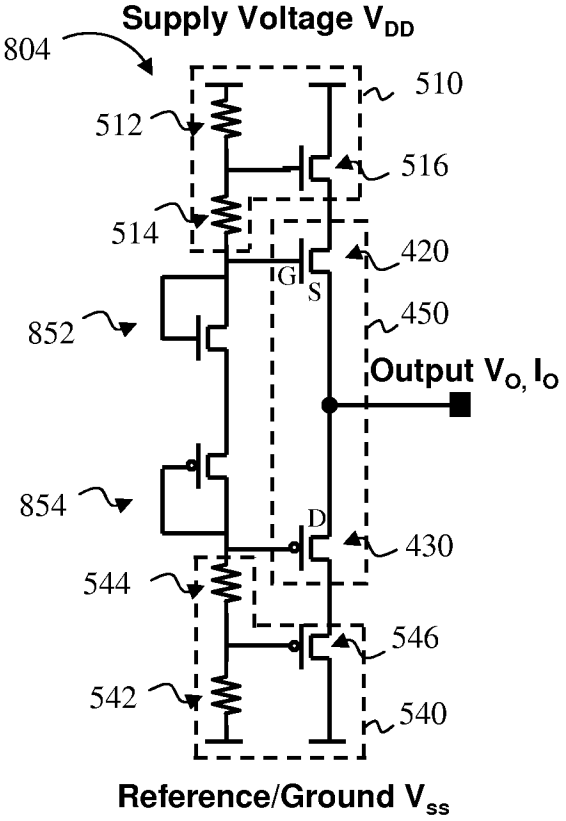
Figure 7:
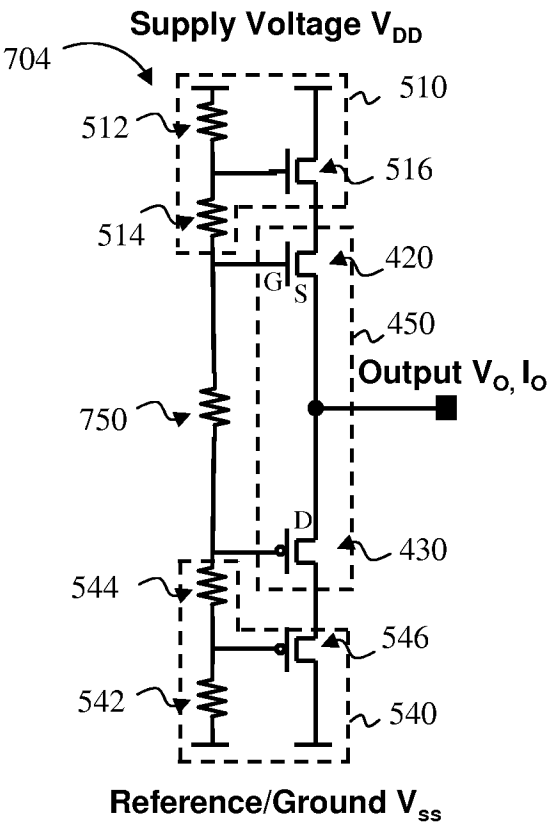
Figure 6:
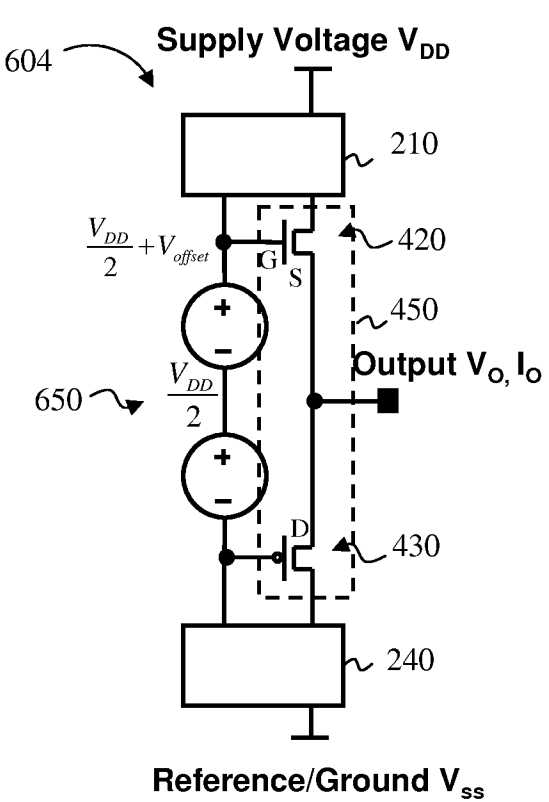

Referring in particular to FIGS. 6-8 in conjunction with FIG. 3, power supply regulators 604, 704, and 804 are similar to power supply regulator 304. Power supply regulator 604 includes first self-bias circuit 210 configured to receive supply voltage $V_{DD}$ from a power supply (e.g., power supply 102 of FIG. 1), second self-bias circuit 240 coupled to reference voltage or ground $V_{SS}$, and clamping circuit 450 coupled between the first and second self-bias circuits 210 and 240. Clamping circuit 450 includes NMOS transistor 420 coupled to first self-bias circuit 210, and PMOS transistor 430 coupled to second self-bias circuit 240.

In accordance with various embodiments of the present disclosure, clamping circuit 450 is configured to generate an output voltage $V_O$ less than the supply voltage $V_{DD}$ at substantially the same time as when the supply voltage $V_{DD}$ is received from the power supply, and/or clamping circuit 450 is configured to generate the output voltage without a timing dead zone. Output voltage $V_O$ and output current $I_O$ are provided at an output node between NMOS transistor 420 and PMOS transistor 430.

In accordance with various embodiments of the present disclosure, clamping circuit 450 is further configured to generate a positive output voltage $V_O$ clamped between a minimum clamp voltage and a maximum clamp voltage. In one example, the positive output voltage is about half of the supply voltage from the power supply, the minimum clamp voltage is about −10% of the positive voltage output, and the maximum clamp voltage is about +10% of the positive voltage output. In another example, the positive output voltage is about 1.65 V at 0 loading current, the minimum clamp voltage is about 1.5 V, and the maximum clamp voltage is about 1.8 V.

Power supply regulator 604 further includes an output current adjusting circuit 650 coupled between first and second self-bias circuits 210 and 240 and between the gate terminals of NMOS transistor 420 and PMOS transistor 430 for adjusting the output current $I_O$ from the power supply regulator.

In accordance with one embodiment of the present disclosure, power supply regulator 604 follows equations (1) and (2) below:

$$Io = \frac{1}{2}k(V_{gs} - V_t)^2 \tag{1}$$

$$V_{gs} = \frac{V_{DD}}{2} + V_{offset} - V_o \tag{2}$$

where $I_O$ is the output current, $V_{gs}$ is the voltage between the gate terminal G and the source terminal S of NMOS transistor 420, $V_t$ is the threshold voltage of NMOS transistor 420, $V_{DD}$ is the supply voltage, $V_{offset}$ is provided by output current adjusting circuit 650, and $V_O$ is the output voltage.

Power supply regulators 704 and 804 are similar to power supply regulator 504 and each regulator includes first self-bias circuit 510 configured to receive a supply voltage $V_{DD}$ from a power supply (e.g., power supply 102 of FIG. 1), second self-bias circuit 540 coupled to a reference voltage or ground $V_{SS}$, and clamping circuit 450 coupled between the first and second self-bias circuits 510 and 540.

In one embodiment, clamping circuit 450 includes NMOS transistor 420 coupled to first self-bias circuit 510, and PMOS transistor 430 coupled to second self-bias circuit 540. In one example, the first self-bias circuit 510 includes a first set of resistors 512, 514 and a first transistor 516 coupled to the supply voltage $V_{DD}$ or power supply, and the second self-bias circuit 540 includes a second set of resistors 542, 544 and a second transistor 546 coupled to the reference voltage $V_{SS}$. In another example, the first transistor 516 is coupled between NMOS transistor 420 and the supply voltage $V_{DD}$, and the second transistor 546 is coupled between PMOS transistor 430 and the reference voltage $V_{SS}$. In yet another example, a gate terminal of the first transistor 516 is coupled between resistors 512 and 514, and a gate terminal of the second transistor 546 is coupled between resistors 542 and 544. Gate terminals of NMOS transistor 420 and PMOS transistor 430 are coupled between resistor 514 and resistor 544.

Power supply regulator 704 further includes a resistor 750 that functions as an output current adjusting circuit, and power supply regulator 804 further includes diode-connected transistors 852 and 854 that function as an output current adjusting circuit. In one example, resistor 750 is coupled between the first set of resistors 512, 514 and the second set of resistors 542, 544 in power supply regulator 704, and/or resistor 750 is coupled between the gate terminals of NMOS transistor 420 and PMOS transistor 430 in power supply regulator 704. In another example, transistors 852, 854 are coupled between the first set of resistors 512, 514 and the second set of resistors 542, 544 in power supply regulator 804 and/or transistors 852, 854 are coupled between the gate terminals of NMOS transistor 420 and PMOS transistor 430 in power supply regulator 804.

Figure 9:
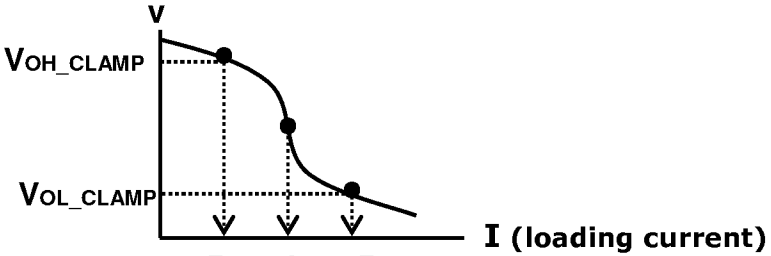
FIG. 9 illustrates an example graph of output current versus output voltage of a power supply regulator in accordance with an embodiment of the present disclosure.

Referring now to FIG. 9, an example graph of output current $I_O$ versus output voltage $V_O$ of a power supply regulator (e.g., power supply regulators 204-804) is shown in accordance with an embodiment of the present disclosure. The power supply regulator follows equations (3)-(6) as shown below:

$$+I_{max} = \frac{1}{2}k(V_{gs1} - V_t)^2 \quad (3)$$

$$V_{gs1} = \frac{V_{DD}}{2} + V_{offset} - V_{OL_CLAMP} \quad (4)$$

$$-I_{max} = \frac{1}{2}k(V_{gs2} - V_t)^2 \quad (5)$$

$$V_{gs2} = \frac{V_{DD}}{2} + V_{offset} - V_{OH_CLAMP} \quad (6)$$

where +Imax is the maximum push current, $V_{OL_CLAMP}$ is the minimum specification voltage (e.g., −10% of the output voltage), and $V_{OH_CLAMP}$ is the maximum specification voltage (e.g., +10% of the output voltage).

As shown in FIG. 9, in accordance with one embodiment of the present disclosure, the power supply regulator generates a positive output voltage clamped between a minimum clamp voltage and a maximum clamp voltage. In one example, the positive output voltage is about half of the supply voltage from the power supply, the minimum clamp voltage is about −10% of the positive voltage output, and the maximum clamp voltage is about +10% of the positive voltage output. In another example, the supply voltage $V_{DD}$ is about 3.3 V, the positive output voltage is about 1.65 V at 0 loading current, the minimum clamp voltage (e.g., $V_{OL_CLAMP}$) is about 1.5 V, and the maximum clamp voltage (e.g., $V_{OH_CLAMP}$) is about 1.8 V.

Figure 10:
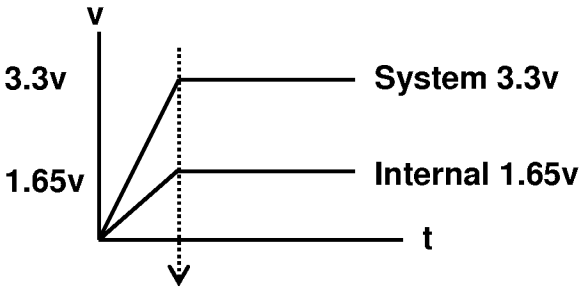
FIG. 10 illustrates an example graph of output voltage versus time of power supplies in accordance with an embodiment of the present disclosure.

FIG. 10 illustrates an example graph of output voltage versus time of a system power supply supplying $V_{DD}$ (e.g., 3.3 V) and an output voltage Vo (e.g., 1.65 V) from a power supply regulator in accordance with an embodiment of the present disclosure. Advantageously, in one embodiment, the power supply regulators of the present disclosure are each configured to generate an output voltage (e.g., 1.65 V) less than the supply voltage (e.g., 3.3 V) at substantially the same time as when the supply voltage is received from the power supply, and/or are each power supply regulator is configured to generate the output voltage without a timing dead zone. In other words, when the system supply voltage is ready, the internal voltage output is provided immediately without a timing dead zone as shown in FIG. 10.

Figure 11:
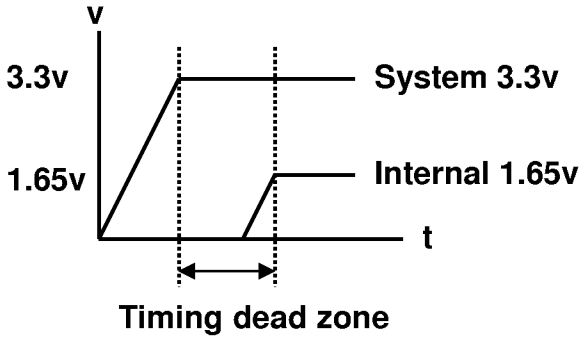
FIG. 11 illustrates an example graph of output voltage versus time of power supplies in accordance with conventional systems and methods.

FIG. 11 illustrates an example graph of output voltage versus time of power supplies in accordance with conventional systems and methods, which shows a timing dead zone between the system supply voltage and when an internal output voltage is provided. During such a timing dead zone, circuits may be damaged because the internal circuit does not have the internal power (e.g., 1.65 V) required to protect the device.

Figure 12:
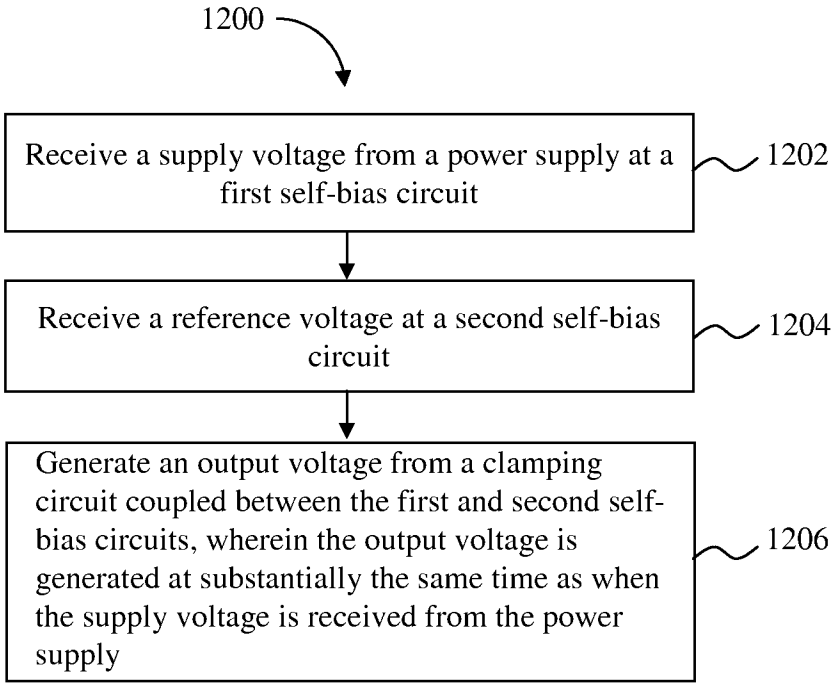
FIG. 12 is a flowchart illustrating a method of regulating a power supply in accordance with various aspects of the present disclosure.

Referring now to FIG. 12, a flowchart illustrates a method 1200 of regulating a power supply in accordance with various aspects of the present disclosure. Method 1200 includes receiving a supply voltage from a power supply at a first self-bias circuit at block 1202, receiving a reference voltage at a second self-bias circuit at block 1204, and generating an output voltage from a clamping circuit coupled between the first and second self-bias circuits at block 1206.

In one embodiment, the clamping circuit includes an NMOS transistor coupled to the first self-bias circuit and a PMOS transistor coupled to the second self-bias circuit, the output voltage is less than the supply voltage, the output voltage is generated at substantially the same time as when the supply voltage is received from the power supply, and/or the output voltage is generated without a timing dead zone.

In accordance with various embodiments of the present disclosure, the output voltage is generated as a positive voltage clamped between a minimum clamp voltage and a maximum clamp voltage. In one example, the positive output voltage is about half of the supply voltage from the power supply, the minimum clamp voltage is about −10% of the positive voltage output, and the maximum clamp voltage is about +10% of the positive voltage output. In another example, the positive output voltage is about 1.65 V at 0 loading current, the minimum clamp voltage is about 1.5 V, and the maximum clamp voltage is about 1.8 V.

It is noted that additional processes may be provided before, during, and after the method 1200 of FIG. 12, and that some other processes may only be briefly described herein.

The present disclosure provides for various advantageous methods and apparatus for regulating a power supply. One of the broader forms of the present disclosure involves a power supply regulator including a first self-bias circuit configured to receive a supply voltage from a power supply, a second self-bias circuit coupled to a reference voltage, and a clamping circuit coupled between the first and second self-bias circuits. The clamping circuit includes a NMOS transistor coupled to the first self-bias circuit and a PMOS transistor coupled to the second self-bias circuit. The clamping circuit is further configured to generate an output voltage less than the supply voltage at substantially the same time as when the supply voltage is received from the power supply.

Another of the broader forms of the present disclosure involves an integrated circuit, including a power supply regulator coupled to a power supply providing a supply voltage, and a circuit configured to receive an output voltage from the power supply regulator. The power supply regulator includes a first self-bias circuit configured to receive the supply voltage from the power supply, the first self-bias circuit including a first set of resistors and a first transistor coupled to the power supply; a second self-bias circuit including a second set of resistors and a second transistor coupled to a reference voltage; and a clamping circuit including an NMOS transistor coupled to the first transistor, and a PMOS transistor coupled to the second transistor. The clamping circuit is configured to generate an output voltage less than the supply voltage at substantially the same time as when the supply voltage is received from the power supply.

Yet another of the broader forms of the present disclosure involves a method of regulating a power supply. The method includes receiving a supply voltage from a power supply at a first self-bias circuit, receiving a reference voltage at a second self-bias circuit, and generating an output voltage from a clamping circuit coupled between the first and second self-bias circuits. The clamping circuit includes an NMOS transistor coupled to the first self-bias circuit and a PMOS transistor coupled to the second self-bias circuit, the output voltage is less than the supply voltage, and the output voltage is generated at substantially the same time as when the supply voltage is received from the power supply.

Advantageously, the present disclosure provides for a "fast" power provider system, apparatus, and/or method utilizing a fast-lock power supply regulator, thus providing a safe output voltage and current in either a power on/off mode or an operation mode. Accordingly, the present disclosure substantially solves the power sequence problem associated with multiple power domains, and substantially solves the timing dead zone problem and associated gate oxide integrity and/or hot carrier injection issues. Furthermore, the power supply regulator of the present disclosure advantageously reduces costs by not requiring greater numbers of electrostatic discharge cells, and requires less current in the power down mode than traditional regulators.

The foregoing has outlined features of several embodiments so that those skilled in the art may better understand the detailed description that follows. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A power supply regulator, comprising:

a first self-bias circuit configured to receive a supply voltage from a power supply and to provide a first intermediate voltage;

a second self-bias circuit coupled to a reference voltage and configured to provide a second intermediate voltage; and a clamping circuit coupled between the first and second self-bias circuits and configured to generate an output voltage, wherein the clamping circuit includes an NMOS transistor coupled to the first self-bias circuit and between the first intermediate voltage and the output voltage, a PMOS transistor coupled to the second self-bias circuit and between the second intermediate voltage and the output voltage, wherein a gate of the NMOS transistor is directly connected to a gate of the PMOS transistor, and wherein the clamping circuit is configured to generate an output voltage less than the supply voltage at substantially the same time as when the supply voltage is received from the power supply.

2. The regulator of claim 1, wherein the clamping circuit is configured to generate the output voltage without a timing dead zone.

3. The regulator of claim 1, wherein a gate of the first transistor is coupled between two resistors, and wherein a gate of the second transistor is coupled between two resistors.

4. The regulator of claim 3, further comprising an output current adjusting circuit including one of a resistor or a transistor, wherein the resistor or the transistor of the output current adjusting circuit is coupled between the resistors of the first self-bias circuit and the resistors of the second self-bias circuit.

5. The regulator of claim 1, wherein the clamping circuit generates a positive output voltage clamped between a minimum clamp voltage and a maximum clamp voltage.

6. The regulator of claim 5, wherein the positive output voltage is about half of the supply voltage from the power supply, the minimum clamp voltage is about −10% of the positive voltage output, and the maximum clamp voltage is about +10% of the positive voltage output.

7. The regulator of claim 5, wherein the positive output voltage is about 1.65 V at 0 loading current, the minimum clamp voltage is about 1.5 V, and the maximum clamp voltage is about 1.8 V.

8. An integrated circuit, comprising:

a power supply regulator coupled to a power supply providing a supply voltage, the power supply regulator including:

a first self-bias circuit configured to receive the supply voltage from the power supply and to generate a first voltage, the first self-bias circuit including a first transistor coupled between the power supply and a clamping circuit, and having a gate coupled to the power supply through a resistor;

a second self-bias circuit including a second transistor coupled between a reference voltage and the clamping circuit and configured to generate a second voltage; and the clamping circuit configured to generate an output voltage less than the supply voltage and including an NMOS transistor coupled to the first transistor and between the first voltage and the output voltage, and a PMOS transistor coupled to the second transistor between the second voltage and the output voltage, wherein the clamping circuit is configured to generate the output voltage at substantially the same time as when the supply voltage is received from the power supply; and an internal circuit configured to receive the output voltage from the power supply regulator.

9. The circuit of claim 8, wherein the clamping circuit is configured to generate the output voltage without a timing dead zone.

10. The circuit of claim 8, wherein the first transistor is coupled between the NMOS transistor and the power supply, and wherein the second transistor is coupled between the PMOS transistor and the reference voltage.

11. The circuit of claim 8, wherein the clamping circuit generates a positive output voltage clamped between a minimum clamp voltage and a maximum clamp voltage.

12. The circuit of claim 11, wherein the positive output voltage is about 1.65 V at 0 loading current, the minimum clamp voltage is about 1.5 V, and the maximum clamp voltage is about 1.8 V.

13. The circuit of claim 8, further comprising an output current adjusting circuit including one of a resistor or a transistor.

14. A method of regulating a power supply, the method comprising:

receiving a supply voltage from a power supply at a first self-bias circuit, wherein the first self-bias circuit includes a first resistor, a second resistor, and a transistor, wherein the first resistor is coupled to the power supply;

generating a first voltage using the first self-bias circuit;

receiving a reference voltage at a second self-bias circuit;

generating a second voltage using the second self-bias circuit; and generating an output voltage from a clamping circuit coupled between the first and second self-bias circuits, wherein the clamping circuit includes an NMOS transistor coupled to the first self-bias circuit between the first voltage and the output voltage and a PMOS transistor coupled to the second self-bias circuit between the second voltage and the output voltage, and wherein the output voltage is less than the supply voltage and generated at substantially the same time as when the supply voltage is received from the power supply.

15. The method of claim 14, wherein the output voltage is generated without a timing dead zone.

16. The method of claim 14, wherein the output voltage is a positive voltage clamped between a minimum clamp voltage and a maximum clamp voltage.

17. The method of claim 14, wherein a gate of the transistor is coupled between the first and second resistors.

18. An integrated circuit, comprising:

a power supply regulator coupled to a power supply providing a supply voltage, the power supply regulator including:

a first self-bias circuit configured to receive the supply voltage from the power supply, the first self-bias circuit including a first set of resistors and a first transistor coupled to the power supply;

a second self-bias circuit including a second set of resistors and a second transistor coupled to a reference voltage; and a clamping circuit including an NMOS transistor coupled to the first transistor, and a PMOS transistor coupled to the second transistor, wherein a gate of the first transistor is coupled between two resistors of the first set of resistors, and a gate of the second transistor is coupled between two resistors of the second set of resistors; and wherein the clamping circuit is configured to generate an output voltage less than the supply voltage at substantially the same time as when the supply voltage is received from the power supply; and an internal circuit configured to receive the output voltage from the power supply regulator.

19. An integrated circuit, comprising:

a power supply regulator coupled to a power supply providing a supply voltage, the power supply regulator including:

a first self-bias circuit configured to receive the supply voltage from the power supply, the first self-bias circuit including a first set of resistors and a first transistor coupled to the power supply;

a second self-bias circuit including a second set of resistors and a second transistor coupled to a reference voltage; and a clamping circuit including an NMOS transistor coupled to the first transistor, and a PMOS transistor coupled to the second transistor, wherein the clamping circuit is configured to generate an output voltage less than the supply voltage at substantially the same time as when the supply voltage is received from the power supply;

wherein the clamping circuit generates a positive output voltage clamped between a minimum clamp voltage and a maximum clamp voltage; and wherein the positive output voltage is about half of the supply voltage from the power supply, the minimum clamp voltage is about −10% of the positive voltage output, and the maximum clamp voltage is about +10% of the positive voltage output; and an internal circuit configured to receive the output voltage from the power supply regulator.

* * * * *